US010913177B2

(12) United States Patent
Mallory et al.

(10) Patent No.: US 10,913,177 B2
(45) Date of Patent: Feb. 9, 2021

(54) PIPE LINING SYSTEM AND METHOD

(71) Applicant: Michels Corporation, Brownsville, WI (US)

(72) Inventors: Paul Mallory, Watertown, CT (US); Albert Thebarge, Watertown, CT (US); Jim Zedler, Brownsville, WI (US); Chris Holzbauer, Brownsville, WI (US)

(73) Assignee: MICHELS CORPORATION, Brownsville, WI (US)

( * ) Notice: Subject to any disclaimer, the term of this patent is extended or adjusted under 35 U.S.C. 154(b) by 29 days.

(21) Appl. No.: 16/364,757

(22) Filed: Mar. 26, 2019

(65) Prior Publication Data

US 2020/0307020 A1 Oct. 1, 2020

(51) Int. Cl.

| | |
|---|---|
| ***B28B 19/00*** | (2006.01) |
| ***B28C 7/16*** | (2006.01) |
| ***E21D 11/00*** | (2006.01) |
| ***E04G 21/00*** | (2006.01) |
| ***B28C 7/10*** | (2006.01) |
| ***B28C 9/04*** | (2006.01) |
| ***B05D 7/22*** | (2006.01) |

(52) U.S. Cl.

CPC ..... *B28B 19/0023* (2013.01); *B05D 7/225* (2013.01); *B28C 7/10* (2013.01); *B28C 7/162* (2013.01); *B28C 9/0472* (2013.01); *E04G 21/00* (2013.01); *E21D 11/00* (2013.01); *B05D 2254/04* (2013.01)

(58) Field of Classification Search

CPC ..... F16L 55/1645; F16L 55/32; F16L 55/18; F16L 55/164; F16L 2101/16; B28B 19/0023; B05B 13/0636; B05C 7/02; Y10S 118/10; E21D 11/00; E04G 21/00; B28C 7/162; B28C 7/10; B28C 9/0472

USPC ..... 118/306

See application file for complete search history.

(56) References Cited

U.S. PATENT DOCUMENTS 2,995,901 A * 8/1961 Kemper ..... E21D 11/105 405/150.1

3,662,045 A 5/1972 Tierling (Continued)

FOREIGN PATENT DOCUMENTS

CN 207122323 * 3/2018

OTHER PUBLICATIONS

Mandil, "Pipeline Rehabilitation and Relining", Municipal Sewer and Water Magazine, Jan. 2014, 18 pages.

(Continued)

*Primary Examiner* — Laura Edwards

(74) *Attorney, Agent, or Firm* — Michael Best & Friedrich LLP

(57) ABSTRACT

A method of lining a pipe with a lining mixture formed from a dry component and a liquid is discussed. The method includes placing the dry component in a dry component surface container located above ground, conveying the dry component from the dry component surface container to a dry component subterranean supply container located underground, conveying the dry component from the dry component subterranean supply container to a mixer located underground, mixing the dry component with the liquid to form the lining mixture, and applying the lining mixture to the pipe with a mixture applicator.

13 Claims, 4 Drawing Sheets

(56) References Cited

U.S. PATENT DOCUMENTS

| | | | | |
|---|---|---|---|---|
| 4,329,937 | A * | 5/1982 | Holland | B05C 7/02 118/105 |
| 4,492,478 | A * | 1/1985 | Ito | B28B 19/0023 366/134 |
| 4,710,058 | A | 12/1987 | Han | |
| 5,141,363 | A | 8/1992 | Stephens | |
| 5,645,375 | A * | 7/1997 | Stephens | C04B 28/26 138/98 |
| 5,791,378 | A | 8/1998 | Stephens | |
| 6,171,024 | B1 | 1/2001 | Curtis et al. | |
| 6,227,813 | B1 | 5/2001 | Leimer | |
| 6,699,324 | B1 * | 3/2004 | Berdin | B05B 13/0636 118/306 |
| 7,905,255 | B2 | 3/2011 | Iwasaki-Higbee | |
| 9,095,866 | B2 | 8/2015 | Gesicki et al. | |
| 9,476,535 | B2 | 10/2016 | Warren | |
| 2010/0301505 | A1 | 12/2010 | Kiest, Jr. | |

OTHER PUBLICATIONS

Selmers, "On-site cement lining", <http://www.selmers.com/pipe-coating-plant/field-equipment/in-situ-cement-lining/> web page available at least as early as Mar. 8, 2017.

* cited by examiner

PIPE LINING SYSTEM AND METHOD

BACKGROUND

The present disclosure relates to a system and method for lining an interior surface of a pipe.

SUMMARY

In one embodiment, the disclosure provides a method of lining a pipe with a lining mixture formed from a dry component and a liquid. The method includes placing the dry component in a dry component surface container located above ground, conveying the dry component from the dry component surface container to a dry component subterranean supply container located underground, conveying the dry component from the dry component subterranean supply container to a mixer located underground, mixing the dry component with the liquid to form the lining mixture, and applying the lining mixture to the pipe with a mixture applicator.

In another embodiment, the disclosure provides a pipe lining system using a lining mixture formed from a dry component and a liquid to line a pipe. The pipe lining system includes a dry component surface container. A surface container conveyor assembly is associated with the dry component surface container. A dry component subterranean supply container is downstream from the surface container conveyor assembly. A supply container conveyor assembly is associated with the dry component subterranean supply container. A mixer is downstream from the supply container conveyor assembly. The mixer mixes the liquid with the dry component to form the lining mixture. A mixture applicator is downstream from the mixer. The mixture applicator applies the lining mixture to the pipe.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
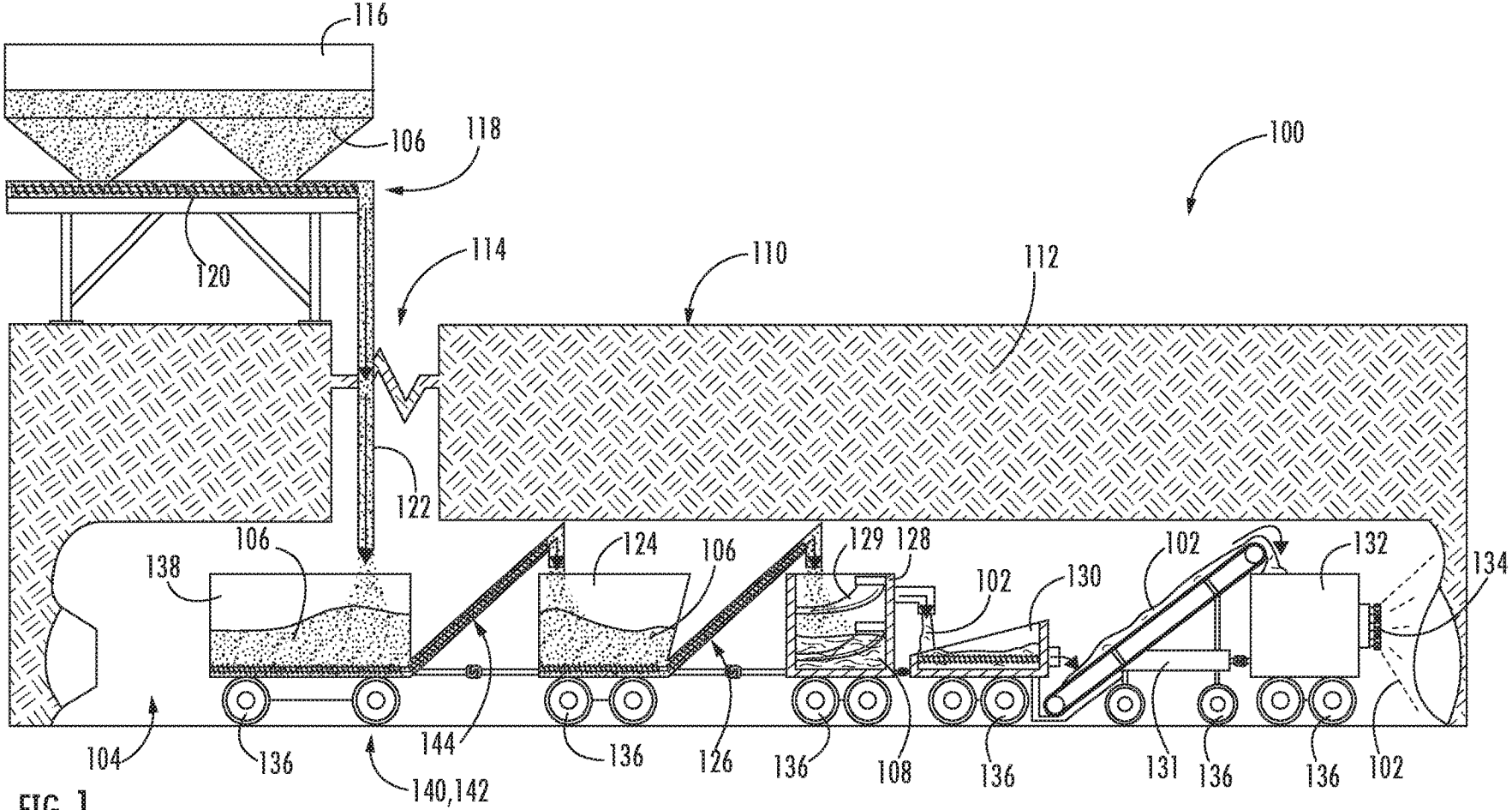
FIG. 1 illustrates a schematic cross-sectional side elevation view of an embodiment of the pipe lining system.

Turning now to FIG. 1, a pipe lining system 100 embodying the present invention is shown. The pipe lining system 100 is used to apply a lining mixture 102 to an interior surface of a pipe 104. The lining mixture 102 is formed from a dry component 106, such as a mortar or cement mix powder, and a liquid 108, such as water. The pipe 104 is located underground below a surface 110 of the ground matrix 112. At least one vertical passage 114 allows access to the pipe 104 from above ground.

The pipe lining system 100 includes a dry component surface container 116. The dry component surface container 116 may be of any appropriate shape and size, but particular embodiments include a relatively high-capacity container. The dry component surface container 116 rests either directly or indirectly on the ground surface 110. In practice, such a container may be filled with material in bulk utilizing, for instance, construction equipment running along the ground surface 110. In the illustrated embodiment, the dry component surface container 116 is an open-top hopper.

Also shown in FIG. 1, the dry component surface container 116 of the illustrated embodiment includes a surface container conveyor assembly 118. In the illustrated embodiment, the surface container conveyor assembly 118 includes a generally lateral conveyance section 120 and a generally vertical conveyance section 122. The generally lateral conveyance section 120 and the generally vertical conveyance section 122 cooperatively convey the dry component 106 from the dry component surface container 116 above the ground surface 110 to the interior of the pipe 104 via the vertical passage 114 defined in the ground matrix 112. In the illustrated embodiment, the generally lateral conveyance section 120 includes a screw conveyor, and the generally vertical conveyance section 122 includes a generally vertical pipe.

With continued reference to FIG. 1, the illustrated embodiment includes a dry component subterranean supply container 124 located underground and downstream from the surface container conveyor assembly 118. Particularly, the dry component subterranean supply container 124 is located within the pipe 104. The dry component subterranean supply container 124 may be of any appropriate size and shape, but particular embodiments include a relatively low-capacity container when compared to the dry component surface container 116. The dry component subterranean supply container 124 may receive the dry component 106 either directly or indirectly from the surface container conveyor assembly 118. In the illustrated embodiment, the dry component subterranean supply container 124 is an open-top hopper. The dry component subterranean supply container 124 of the illustrated embodiment includes a supply container conveyor assembly 126. In the illustrated embodiment, the supply container conveyor assembly 126 includes a screw conveyor.

As shown in FIG. 1, a mixer 128 is located downstream from the supply container conveyor assembly 126. The mixer 128 receives the dry component 106 from the supply container conveyor assembly 126 and mixes the liquid 108 with the dry component 106 to form the lining mixture 102. An example of a mixer 128 includes one or more mixing paddles 129 to mix the liquid 108 with the dry component 106 in a manner similar to a concrete mixer. The mixer 128 is illustrated as having an open top to receive the dry component 106. The liquid 108, such as water, is supplied from a tank fluidly coupled to the mixer 128. This tank (not shown) can be mounted to the mixer 128, or it may be located elsewhere, such as above the ground surface 110, with one or more lines feeding liquid 108 to the mixer. In some embodiments, the liquid 108 may simply be supplied from a municipal water source to the mixer 128.

A wet mix conveyor 130 receives the lining mixture 102 from the mixer 128. The wet mix conveyor 130 is illustrated as having an open-top design with walls extending higher on the downstream end than the upstream end. This angled design of the illustrated embodiment may aid in containing the lining mixture 102 even if the lining mixture 102 tends to bunch up at the downstream end of the wet mix conveyor 130. The illustrated embodiment includes a wet mix conveyor 130 having a screw conveyor. The screw conveyor of the wet mix conveyor 130 may serve to move the lining mixture 102 while also further mixing the lining mixture 102 to ensure better incorporation of the dry component 106 and the liquid 108. The screw conveyor of the wet mix conveyor 130 is shown in a horizontal orientation, but other embodiments may include an inclined screw conveyor.

A belt conveyor 131 receives the lining mixture 102 from the wet mix conveyor 130. The belt conveyor 131 is illustrated schematically and may include further components such as side containment walls that are angled upwardly and outwardly from the belt of the belt conveyor 131 to aid in containing the lining mixture 102 as it travels along the belt. The belt conveyor 131 moves the lining mixture 102 both horizontally to move farther along the pipe 104 and vertically to elevate the lining mixture 102 so it is high enough to drop into an open top of a downstream mixture applicator 132. Some embodiments include an inclined screw conveyor instead of the belt conveyor 131. In such embodiments, the inclined screw conveyor may be separate from the wet mix conveyor 130 or integrated therewith as a single assembly.

The mixture applicator 132 receives the lining mixture 102 from the belt conveyor 131. The mixture applicator 132 is configured to apply the lining mixture 102 to the interior surface of the pipe 104. As an example, the illustrated embodiment includes multiple spray nozzles 134 to spray the lining mixture 102 onto the interior surface of the pipe 104. Other lining mixture application configurations are also contemplated.

The mixture applicator 132 is configured to move through the interior of the pipe 104 to apply the lining mixture 102 along the interior surface of the pipe. In the illustrated embodiment, the belt conveyor 131, the wet mix conveyor 130, and the mixer 128 move with the mixture applicator 132. To facilitate the movement of the mixture applicator 132, the belt conveyor 131, the wet mix conveyor 130, and the mixer 128, each may include one or more wheels 136. Of course, other structures facilitating movement of the mixture applicator 132 and the mixer 128 are contemplated such as, for instance, one or more tracks, sleds, bearings, rollers, and the like.

The dry component subterranean supply container 124 also moves along the interior of the pipe 104. As discussed above with regard to the mixture applicator 132 and the mixer 128, the dry component subterranean supply container 124 may also include one or more wheels 136. In the illustrated embodiment, the dry component subterranean supply container 124 moves with the mixer 128. Particularly, the dry component subterranean supply container is coupled with or connected to the mixer 128. This connection may be permanent, but this connection could instead be a releasable connection.

Figure 2:
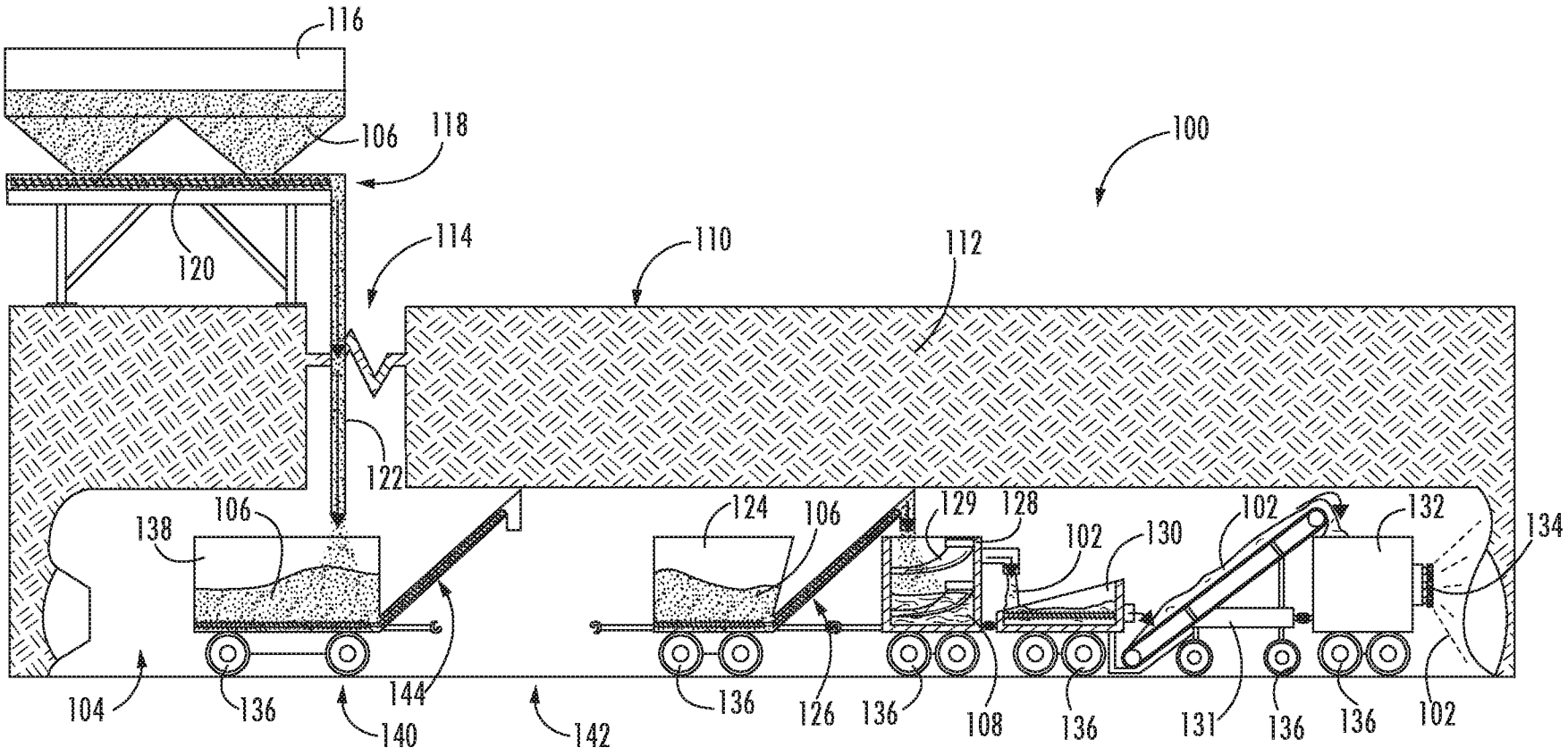
FIG. 2 illustrates the pipe lining system of FIG. 1 with the mixer and mixture applicator further along in a pipe while the mobile container receives the dry component.
Figure 3:
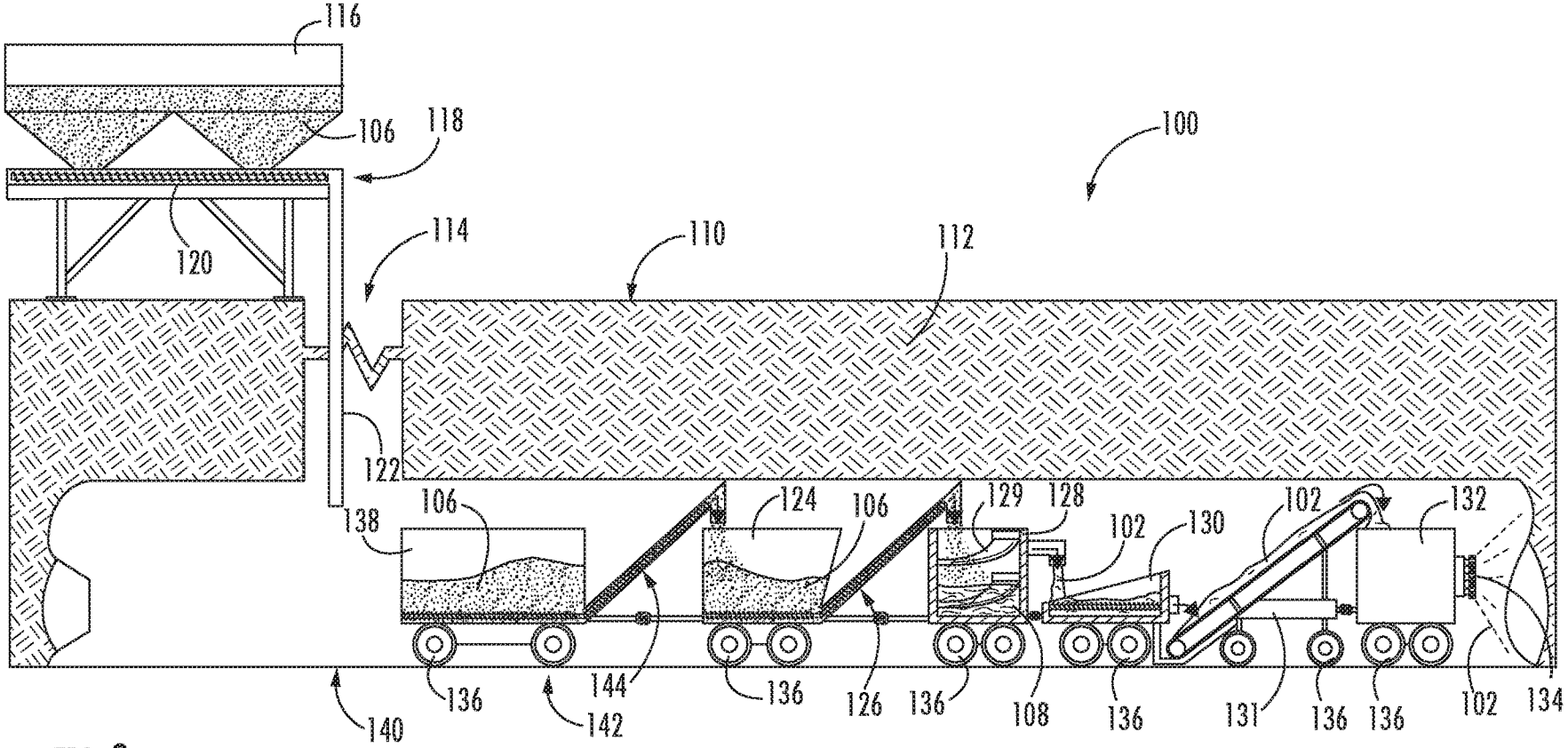
FIG. 3 illustrates the pipe lining system of FIG. 1 with the mobile container moved to a loading position to convey the dry material to the supply container.

Referring to FIGS. 1-3, the pipe lining system 100 may further include a dry component subterranean mobile container 138 located underground in the interior of the pipe 104. In the illustrated embodiment, the dry component subterranean mobile container 138 is located downstream from the surface container conveyor assembly 118 and upstream of the dry component subterranean supply container 124. Dry component 106 leaves the surface container conveyor assembly 118 and is received in the dry component subterranean mobile container 138 at a loading location 140. After loading with dry component 106, the dry component subterranean mobile container 138 moves along the interior of the pipe 104 from the loading location 140 to an unloading location 142 adjacent the dry component subterranean supply container 124. As discussed above with the other components of the pipe lining system 100, the dry component subterranean mobile container 138 may include one or more wheels 136. In the illustrated embodiment, the dry component subterranean mobile container 138 is an open-top hopper.

A mobile container conveyor assembly 144 is associated with the dry component subterranean mobile container 138. The mobile container conveyor assembly 144 includes a screw conveyor in the illustrated embodiment. Also in the illustrated embodiment, the mobile container conveyor assembly 144 is connected to and moves with the dry component subterranean mobile container 138. The dry component 106 leaves the mobile container conveyor assembly 144 and enters the subterranean supply container 124 when the dry component subterranean mobile container 138 is in the unloading location 142. The unloading location 142 moves with the dry component subterranean supply container 124 as the dry component subterranean supply container, the mixer 128, and the mixture applicator 132 move along the interior of the pipe 104. As such, the dry component subterranean mobile container 138 makes runs back and forth from below the generally vertical conveyance section 122 of the surface container conveyance assembly 118 to the dry component subterranean supply container 124. In some embodiments, the dry component subterranean mobile container 138 removably connects to the dry component subterranean supply container 124 when the dry component subterranean mobile container 138 is unloading the dry component 106 into the dry component subterranean supply container 124 at the unloading location 142.

Figure 4:
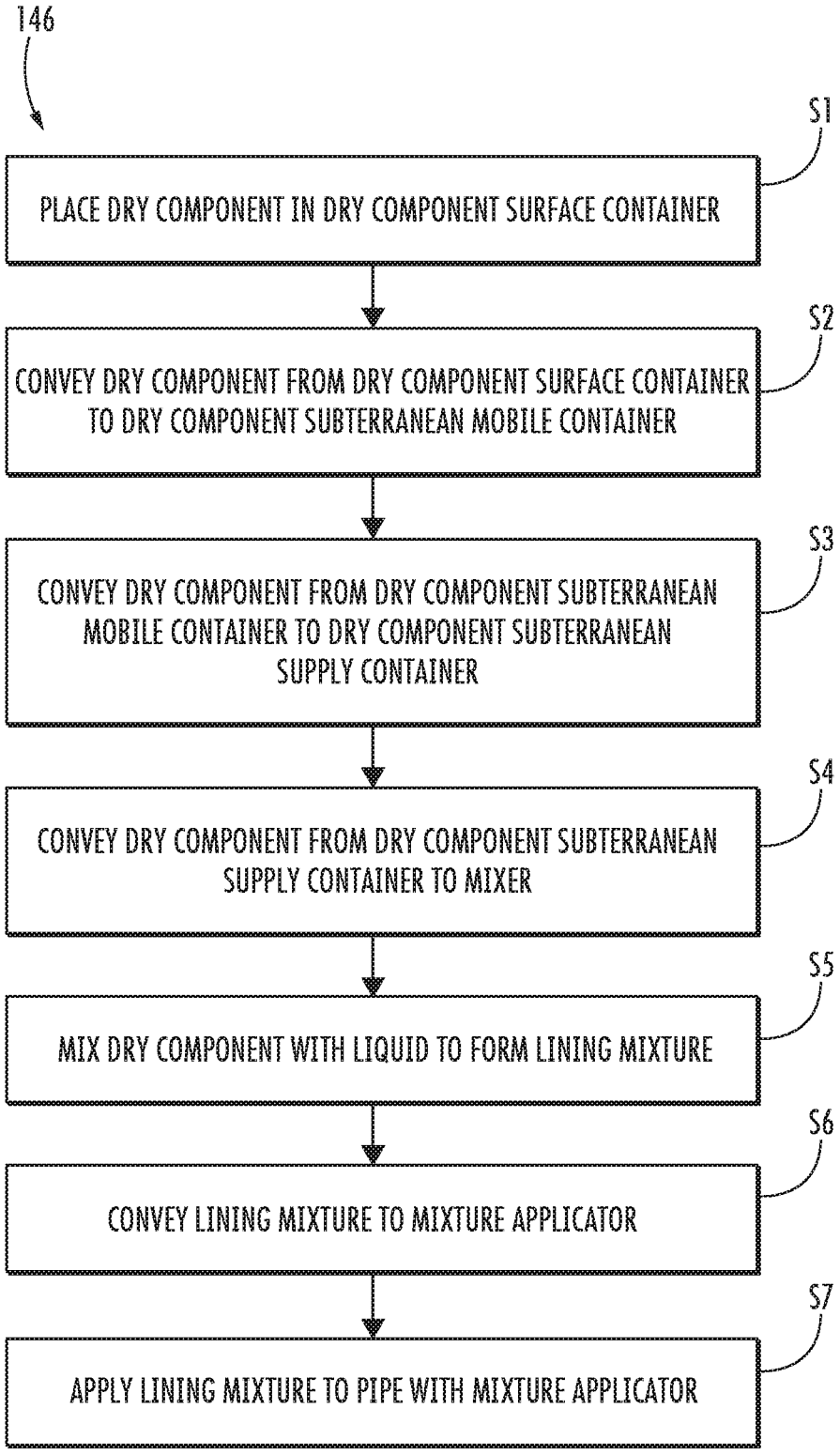
FIG. 4 illustrates an example flow diagram relating to an embodiment of the method of lining a pipe.

Turning now to FIG. 4, the present disclosure also relates to a method 146 of lining a pipe 104 with a lining mixture 102 formed from a dry component 106 and a liquid 108. The illustrated embodiment of the method starts at step S1, wherein the dry component 106 is placed in the dry component surface container 116 aboveground, such as on the ground surface 110. Next, the dry component 106 is conveyed from the dry component surface container 116 to the dry component subterranean mobile container 124, which is located underground in the interior of the pipe 104, in a second step S2. Then, in a third step S3, the dry component 106 is conveyed from the dry component subterranean mobile container 138 to the dry component subterranean supply container 124. Steps S2 and S3 indirectly accomplish a step of conveying the dry component 106 from the dry component surface container 116 to the dry component subterranean supply container 124. Then, in a fourth step S4, the dry component 106 is conveyed from the dry component subterranean supply container 124 to the mixer 128, which is located underground in the interior of the pipe 104. The liquid 108 and the dry component 106 are then mixed by the mixer 128 to form the lining mixture 102 in a fifth step S5. In a sixth step S6, the lining mixture 102 is conveyed to the mixture applicator 132, being carried by both a wet mix conveyor 130 and a belt conveyor 131. Finally, in a seventh step S7, the lining mixture 102 is applied to the interior surface of the pipe 104 with the mixture applicator 132.

As shown in FIG. 1, the mixture applicator 132, the belt conveyor 131, the wet mix conveyor 130, the mixer 128, and the dry component subterranean supply container 124 may be positioned such that the loading location 140 and the unloading location 142 are the same location. In such a situation, the dry component subterranean mobile container 138 simply remains stationary while receiving the dry component 106 from the surface container conveyor assembly 118 and also while the mobile container conveyor assembly 144 delivers the dry component to the dry component subterranean supply container 124.

As shown in FIGS. 2 and 3, however, the mixture applicator 132, the belt conveyor 131, the wet mix conveyor 130, the mixer 128, and the dry component subterranean supply container 124 are, more often than not, positioned such that the loading location 140 and the unloading location 142 are separated by some distance along the interior of the pipe 104. In this situation, the second step S2 includes the dry component subterranean mobile container 138 receiving the dry component 106 from the surface container conveyor assembly 118, particularly from the generally vertical conveyance section 122, while the dry component subterranean mobile container is in the loading location 140. Next, the third step S3 includes the dry component subterranean mobile container 138 moving from the loading location 140, or first underground location, to the unloading location 142, or second underground location. The third step S3 also includes delivering the dry component 106 to the dry component subterranean supply container 124 from the dry component subterranean mobile container 138 via the mobile container conveyor assembly 144 while the dry component subterranean mobile container is in the unloading location 142.

In this described method, the second, third, and fourth steps S2, S3, S4 further include conveying the dry component 106 with a respective screw conveyor included as part of each of the surface container conveyor assembly 118, the mobile container conveyor assembly 144, and the supply container conveyor assembly 126. The mobile container conveyor assembly 144 and the supply container conveyor 118 include a first and second inclined screw conveyor, respectively, in some embodiments. Also in this described method, the sixth step S6 further includes conveying the lining mixture 102 with a respective screw conveyor included as part of the wet mix conveyor 130.

With regard to the methods contemplated herein, the above discussion of illustrated or example embodiments should not be considered to be limiting. The method steps may be carried out in any appropriate order, and steps may be added or removed as appropriate for a given application.

Although embodiments including the dry component subterranean mobile container 138 have been discussed, the current disclosure also contemplates embodiments without the dry component subterranean mobile container. In such embodiments, the dry component subterranean supply container 124 would make trips back and forth from a location receiving the dry component 106 from the surface container conveyor assembly 118 to a location delivering the dry component to the mixer 128.

In addition to the example embodiments discussed explicitly herein, the current disclosure contemplates other embodiments having additional or alternative features or configurations. Indeed, features from one embodiment may be added to or may replace features of another embodiment to form still another embodiment. As such, the discussion above should be viewed as exemplary in nature and not as a limit on the following claims. Various features and advantages of the disclosure are set forth in the following claims.

What is claimed is:

1. A pipe lining system using a lining mixture formed from a dry component and a liquid to line a pipe, the pipe lining system comprising:

a dry component surface container;

a surface container conveyor assembly associated with the dry component surface container;

a dry component subterranean supply container downstream from the surface container conveyor assembly;

a supply container conveyor assembly associated with the dry component subterranean supply container;

a mixer downstream from the supply container conveyor assembly, the mixer configured to mix the liquid with the dry component to form the lining mixture;

a mixture applicator downstream from the mixer, the mixture applicator configured to apply the lining mixture to the pipe, a dry component subterranean mobile container downstream from the surface container conveyor assembly and upstream from the dry component subterranean supply container, wherein the dry component subterranean mobile container is movable relative to the dry component subterranean supply container from a loading location to an unloading location;

wherein, at the loading location, the dry component subterranean mobile container is positioned to receive the dry component from the surface container conveyor assembly; and wherein, at the unloading location, the dry component subterranean mobile container is positioned to deliver the dry component to the dry component subterranean supply container.

2. The pipe lining system of claim 1, further comprising a mobile container conveyor assembly associated with the dry component subterranean mobile container to deliver the dry component to the dry component subterranean supply container.

3. The pipe lining system of claim 2, wherein the mobile container conveyor assembly is connected to the dry component subterranean mobile container and moves with the dry component subterranean mobile container.

4. The pipe lining system of claim 1, wherein the dry component subterranean supply container moves with the mixer; and the unloading location is associated with the dry component subterranean supply container and moves with the dry component subterranean supply container.

5. The pipe lining system of claim 4, wherein the dry component subterranean supply container is connected to the mixer.

6. The pipe lining system of claim 1, wherein the dry component subterranean mobile container removably connects to the dry component subterranean supply container at the unloading location.

7. The pipe lining system of claim 2, further comprising a wet mix conveyor downstream from the mixer.

8. The pipe lining system of claim 7, further comprising a belt conveyor downstream from the wet mix conveyor.

9. The pipe lining system of claim 8, wherein each of the mixer, the wet mix conveyor, the belt conveyor, and the mixture applicator includes wheels.

10. The pipe lining system of claim 2, wherein each of the supply container conveyor assembly and the mobile container conveyor assembly includes a screw conveyor.

11. The pipe lining system of claim 2, wherein the surface container conveyor assembly includes a generally vertical conveyance section.

12. The pipe lining system of claim 1, wherein the surface container conveyor assembly includes a screw conveyor.

13. The pipe lining system of claim 1, wherein the dry component subterranean mobile container includes a screw conveyor assembly that is connected to and moves with the dry component subterranean mobile container between the loading location and the unloading location, wherein the screw conveyor assembly delivers the dry component from the dry component subterranean mobile container to the dry component subterranean supply container.

* * * * *